US007261949B2

(12) United States Patent
Pepin

(10) Patent No.: US 7,261,949 B2
(45) Date of Patent: Aug. 28, 2007

(54) THICK FILM COMPOSITION YIELDING MAGNETIC PROPERTIES

(75) Inventor: John Graeme Pepin, Raleigh, NC (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/630,296

(22) Filed: Jul. 30, 2003

(65) Prior Publication Data

US 2004/0058184 A1 Mar. 25, 2004

Related U.S. Application Data

(63) Continuation-in-part of application No. 10/025,072, filed on Dec. 19, 2001, now abandoned.

(51) Int. Cl.
*H01F 10/08* (2006.01)
*H01F 10/14* (2006.01)

(52) U.S. Cl. ..... 428/611; 428/692; 252/62.51 R; 252/62.54; 252/62.57; 252/62.58

(58) Field of Classification Search ..... 426/611, 426/692, 694 B; 252/62.51 R
See application file for complete search history.

(56) References Cited

U.S. PATENT DOCUMENTS 4,105,572 A 8/1978 Gorondy
4,733,249 A 3/1988 Iwamoto et al.
4,881,988 A * 11/1989 Bonser ..... 148/300
5,425,166 A 6/1995 Hastings et al.
5,430,613 A 7/1995 Hastings et al.
5,682,670 A 11/1997 Bell et al.
6,004,617 A 12/1999 Schultz et al.
6,038,523 A 3/2000 Akahane et al.
6,075,432 A 6/2000 Reymond
6,517,934 B1 * 2/2003 Kishimoto ..... 428/323

OTHER PUBLICATIONS

English Abstract: JP 05290374, TDK Corp, Nov. 1993.*
English Abstract: KR 2003013674, Nanonix Inc, Feb. 2003.*
Article: High-Energy-Product (Pr-Nd-Ce)FeB Magnets Produced Directly from Mixed-Rare-Earth-Oxide Feed for MRI Medial Imaging Applications; Benz et al.; Jun. 2000.*
Program of the ISAMM'02 International Symposium on Advanced Magnetic Materials; Oct. 2002.*
J. Topfer, B. Pawlowski, and A. Rhamig, Preparation and Properties of Nd-Fe-B Thick Layers for Magnetic Standards, 5th Symposium, "Megnetoresistive Sensors: Fundametals, Preparation, Use", Mar. 10-11, 1999, Wetzlar, pp. 1-7.

* cited by examiner

*Primary Examiner*—John J. Zimmerman
*Assistant Examiner*—Jason L. Savage

(57) ABSTRACT

The invention is directed to a magnetic thick film composition comprising particles of permanent magnetic materials dispersed in organic medium wherein the medium comprises a polymer selected from polyurethane, phenoxy and mixtures thereof, and organic solvent.

17 Claims, No Drawings

THICK FILM COMPOSITION YIELDING MAGNETIC PROPERTIES

CROSS-REFERENCE TO RELATED APPLICATIONS

This application is a continuation-in-part of U.S. Application Ser. No. 10/025,072, filed Dec. 19, 2001, now abandoned.

FIELD OF THE INVENTION

The invention is directed to a thick film composition which upon processing exhibits magnetic property characteristics of a permanent polymer bonded magnet.

BACKGROUND OF THE INVENTION

Two principal types of magnetic materials exist: materials that exhibit "soft" or "hard" (also known as "permanent") magnetic characteristics. These materials are differentiated on the basis of their B-H hysteresis loops, when the curves are plotted as magnetic remanence (B) versus coercivity (H). In a standard accepted orientation, magnetic remanence B is plotted on the Y (ordinate) axis and coercivity H on the X (abscissa) axis. The area of this curve is called the BH product or the "energy" of the material and is expressed in units of energy.

Soft magnetic materials are characterized by low magnetic coercivities, typically below 12.5 Oe, and high magnetic permeabilities. Magnetic permeability is the magnetic induction response of a material to an applied magnetic or coercive field and is in general not a constant or linear with the applied magnetic field. Soft magnets are used in applications where high magnetic permeability is required to achieve high magnetic induction. Such materials have low coercivity, such that the magnetic induction can be readily removed or reversed when the applied field is changed in magnitude or direction. Soft magnetic materials are also termed "low energy" in that the BH product is low. Such materials are used in transformers, generators, and electrical motors, among other applications. The materials which comprise the soft magnetic materials family include iron and its various alloys for low frequency applications, and at higher frequencies ceramic oxides based on iron oxide with various modifying additives are used due to their lower electrical conductivity and therefore lower electrical losses at the higher applied frequencies.

"Hard" or permanent magnetic materials are those which have both high coercivities and high magnetic induction. Typical coercivities are greater than 125 Oe. Such materials retain their magnetization after removal of the applied magnetic field and large magnetic fields must be applied to reverse or remove the residual magnetization. These materials are termed high energy in that a plot of their BH properties is a very open hysteresis curve and this curve has a significant area and therefore a high BH energy product. Hard magnetic materials find many applications in technology where a strong and permanent magnetic field is required such as in magnets for electrical motors, electrical meters, loudspeakers, etc.

One type of hard magnet composition is the magnet made from materials within the Nd—Fe—B system, commonly termed "Neo" magnets. Additions of small amounts of other materials are made to tailor the magnetic properties of these materials to desired characteristics. Such magnets are fabricated into required forms for various applications, for example, melts using a variety of foundry techniques such as casting followed by machining. Powder metallurgical techniques are also used on the powder forms of the material such as sintering or hot pressing with and without a binder. Such techniques have advantages in that the magnetic properties of the finished article are not diluted by the presence of a non-magnetic binder. However, such forming processes are expensive and labor intensive in that complex dyes and molds need be used and post-forming machining is typically required. Complex shapes are difficult and expensive to make using these methods.

Polymer bonded forms of the Neo materials are also made using injection molding, compression molding, calendering, rolling, or other methods known in the art. In these techniques the Neo powder is mixed and dispersed into a polymeric medium and then formed using the various techniques into a near-net shape. Polymers used to make flexible bonded magnets include DuPont HYPALON® chlorosulfonated polyethylene, DuPont TYRIL® chlorinated polyethylene, nitrile rubber, vinyl and others. Polymers used for stiff and/or rigid bonded magnets include acrylics, nylon, polyphenylene sulfide, DuPont TEFLON®, thermoset epoxies and others.

A limitation of the technique for making polymer bonded magnets containing Neo powders is the amount of residual polymer that remains after processing. For instance, a magnet such as one that might be mounted on a refrigerator containing Ba/Sr ferrite powders has about 75% of its weight in magnetic powder, the remainder being polymer. The high amount of residual polymer dilutes the magnetic properties of the finished magnet such that the total magnetic flux and total magnetic strength of the piece is reduced significantly. In addition, the above processes have several limitations. One is the inability to produce thin, durable films of below approximately 10 mil manufactured thickness. Another is forming mechanically flexible and complex shapes without significantly wasting materials in a trimming or machining process.

The compositions of the present invention utilize thick film technology to solve the problems discussed herein. The composition upon processing yields a low cost, patternable, high energy magnetically permanent material.

SUMMARY OF THE INVENTION

The invention is directed to a magnetic thick film composition comprising particles of permanent magnetic materials dispersed in organic medium wherein the medium comprises a polymer selected from polyurethane, phenoxy and mixtures thereof, and organic solvent.

DETAILED DESCRIPTION

Magnetic thick film compositions are dispersions of particulates of permanent magnetic material powders in an organic medium suitable for application by screen-printing and other deposition techniques. The composition is designed to have a magnetic particle loading as high as possible to result in a deposition of the permanent magnetic particles in as high a volumetric concentration as possible which enables enhanced magnetic properties. The printed thickness of the composition is characteristic of that produced by typical thick film screen-printing processes by using one or more printing steps. Such thicknesses can be in the range of about 0.5 mil and up to about 20 mils, although extensions beyond these ranges can be achieved by using specialized thick film printing techniques. Such thicknesses are intermediate between that obtainable using thin film evaporative deposition technology and the thicknesses obtainable using conventional injection molding or roll-compaction technology. The composition is primarily applied by screen-printing on a rigid or flexible substrate of any type compatible with the chemistry of the composition. Other deposition methods suitable to the viscosity and rheology of the thick film composition can be used. The deposition is then dried or cured to produce a thin, dense film containing a high volume fraction of the magnetic powder phase. Additional patterning processing can be done such as cutting, slitting, laser ablation, sand-blasting, among others to form the desired pattern. In addition, depositions of a variety of screen printed patterns may be used to not only result in a patterning of the print within the two-dimensional plane of the printed substrate, but subsequent prints can be made of different patterns such that a three dimensional construct can be made. Such constructs are expected to have numerous applications in technology areas where a low cost, thin, dense, flexible, patternable film containing magnetically hard particles would be advantageous.

The main components of the magnetic thick film composition are discussed herein below.

A. Magnetic Particles

Several classes of magnetic particulate materials may be used in the invention. All are conventional and commercially available. The magnetic materials provide magnetic functionality to a cured thick film composition. Examples include: permanent magnetic steels; AlNiCo alloys within the system Al—Ni—Co; alkaline earth ferrite materials such as materials within the Ba—Fe—O or Sr—Fe—O system as characterized for example by compounds such as $BaO.6Fe_2O_3$ and $SrO.6Fe_2O_3$ and mixtures thereof; alloys in the Sm—Co system, such as for example $SmCo_5$ and $Sm_2Co_{17}$; alloys in the Pt—Co system; and alloys in the Nd—Fe—B system, also known as the "Neo" magnets. The term "Neo" describes magnetic materials within the Nd—Fe—B system, with appropriate additives made for tailoring of the magnetic properties, including other rare earth metals that contribute to the magnetic properties selected from Pr, Sm, Eu, Gd, and mixtures thereof; and other transition metals including Cr, Ni, Co, Mn, and mixtures thereof.

The AlNiCo, alkaline earth ferrites and the Neo magnets are manufactured in commercially large quantities. The Sm—Co and Pt—Co are not as widely used for reasons of cost and availability.

The Neo magnets are preferred because of their higher coercivity, higher residual magnetization and higher energy product and overall increased performance versus other magnetic materials. Due to the components found in this series of magnets, the cost is lower versus the cost of magnets made with compositions containing Pt, Sm and Co. The high energy product of this type of magnetic material makes it ideal for use in applications where a high residual magnetization and high magnetic flux is required, weight and/or magnet volume is a prime consideration, and where it is necessary to have high intrinsic coercivities such that the magnetic flux cannot be easily reversed or removed. Such materials allow fabrication of magnets with high strengths allowing miniaturization of electronic components. Materials in the Neo system are typically made by high temperature reaction and sintering of the ingredients in ceramic crucibles or, more generally, by rapid quenching of the molten alloy onto a surface which quenches the molten droplets into a form resembling a thin ribbon which is then processed into the appropriate particle size and magnetic properties. Atomization from the melt is also used in the manufacture of these materials in a fine powder form.

The principal disadvantages of the Neo materials are: (1) pyrophoricity and reactivity in air if formed into fine powders with high surface areas, (2) relatively low Curie point of the materials of 300 to 500° C., and (3) tendency of the materials to surface oxidize on environmental exposure due to the high Fe content.

The magnetic particles are found in the composition in the range of 50-91% by weight and all ranges contained therein with 80-91% being preferred. Maximized loading of the composition with magnetic powder is desirable to maximize printed film performance with respect to magnetic properties.

B. Organic Medium

The magnetic particles and any other powders are typically mixed with an organic medium by mechanical mixing and other dispersion processes to form a viscous paste-like composition having suitable consistency and rheology for screen printing. A wide variety of liquids can be used as the organic medium. The organic medium must be one in which the magnetic particulate solids are dispersible with an adequate degree of dispersion stability. The rheological properties of the medium must be such that they lend good application properties to the composition. Such properties include: dispersion of the particulate solids with an adequate degree of dispersion stability, good application properties of the composition, appropriate viscosity, suitable rheological thixotropy, appropriate wettability of the substrate and the powder solids, a suitable drying and curing rate, and a dried film strength sufficient to withstand handling and subsequent processing. The organic medium must also be such that reactivity of the components of the medium with the magnetic powder is absent or non-deleterious, since such reactivity can lead to detrimental behavior such as viscosity drift wherein the viscosity of ink increases or decreases with time to an unworkable consistency. The organic medium is conventional in the art of polymer thick film compositions and is typically a solution of one or more polymers which may be natural or synthetic polymers in a solvent or mixtures of solvents.

The compositions typically do not include a glass frit or mixtures of frits since they are cured, and not fired. Some examples of typical polymers employed in polymeric thick film compositions are polyesters, acrylics, vinyl chlorides, vinyl acetates, urethanes, polyurethanes, epoxies, phenolic polymer systems, or mixtures thereof. Due to the need for the cured print of the composition to be durable and handleable during the manufacturing process, it is important to select a polymer that imparts the properties of toughness, ductility, impact resistance and flexibility to the finished cured print, while maintaining minimum polymer content to maximize the metal content of the printed composition and therefore optimize and maximize magnetic properties. Examples of polymer categories that exhibit these properties are the phenoxy and polyurethane polymers. In the case of phenoxy polymers, the properties of toughness, ductility, and flexibility are obtained by choosing a polymer with a high molecular weight and approximately linear molecular structure. For example, Phenoxy Specialties (Inchem Corp) phenoxy polymer type PKHH has a glass transition temperature ($T_g$) of about 95° C., a number average molecular weight of $M_n$=10,000 to 16,000 and a $M_w$ molecular weight average of 40,000 to 60,000. It has a property of being a linear polymer that aids in imparting the required properties to the finished dried and cured print. These properties act to allow manufacture of a composition with a maximized viscosity but with a minimum polymer content. The polyurethane polymers exhibit much of the same type of properties. A specific example of such a polyurethane polymer is Huntsman Polyurethanes type PA279-503.

Solvents suitable for use in the composition must dissolve the polymer selected. Examples of such solvents are listed hereafter: propylene glycol monomethyl ether acetate, methyl propanol acetate, 1-methyl-2propanol acetate, methyl cellosolve acetate, pentyl propionate, diethylene oxalate, dimethyl succinate, dimethyl glutarate, dimethyl adipate, methyl isoamyl ketone, methyl n-amyl ketone, cyclohexanone, diacetone alcohol, diisobutyl ketone, n-methyl pyrolidone, butyrolactone, isophorone, methyl n-isopropyl ketone. Various combinations of these and other solvents are formulated to obtain the desired viscosity and volatility requirements for the process in which the polymer thick film composition is to be employed.

The organic medium is required to impart the necessary adhesion to the desired substrate, and it also provides the composition with the required surface hardness, resistance to environmental changes, flexibility and toughness. Additives as known to those skilled in the art may be employed in the organic medium to fine-tune the viscosity and rheology for printing and other forms of composition deposition.

In general, the ability of an organic medium to be formulated to maximum viscosity at minimum polymer content is directly related to the polymer's molecular weight and the complex relationship of the solubility characteristics of the polymer versus the solvent. For maximum viscosity at minimum polymer content, a high molecular weight polymer is desired, but the polymer must also be readily soluble in the solvents used to make the medium. In addition, the chemical interactions between the polymer and the solvents can also be tailored to provide maximum viscosity of the medium solution at minimum polymer content. The purpose for this property is to enable the thick film composition to print or be deposited with reasonable and useful screen printing or deposition properties, and to cure and have minimum residual polymer content and therefore maximum magnetic particulate material content in the printed, dried and/or cured film. A typical viscosity for a high volume screen-printing ink suited to web type or reel-to-reel high volume screening printing is in the range of 5 to 30 Pas. Typical polymer loading for such mediums used in this application is about 10 to 25% polymer, this loading being determined to a large extent by the molecular weight of the polymer and its solubility characteristics in the solvents used.

After applying the thick film composition on a substrate, the composition is typically dried by heating at temperatures up to about 150° C. which causes the volatile solvents to be substantially volatilized. The term "substantially" means removal of the solvent to a point to provide adequate adhesion to the surface or substrate upon which the composition is deposited and to render the printed film into a useful and stable configuration. The drying temperature is usually limited by the thermal properties of the substrate and the properties of the polymer contained in the organic medium. After or during drying, depending on the application, the composition may undergo a curing process wherein the polymer will bind the powder to form a pattern or other desired result. The organic polymer is found in the composition in the range of up to a maximum of about 15% of the total composition and all ranges contained therein, but preferably at as low a level as possible so as to maximize the metal phase content of the print.

C. Processing

To produce a polymer thick film composition, the particulate solids such as the magnetic particles are mixed with the essentially inert liquid medium as described above by mechanical mixing using devices similar to a planetary mixer, then dispersed on a three roll mill, an intense high shear mixer or other dispersion devices to form a viscous paste-like composition having suitable consistency and rheology for screen-printing. Other finished paste rheologies may be selected for applications such as dipping, spraying, and other deposition processes. The ratio of medium to solids in the dispersions can vary considerably and depends upon the manner in which the dispersion is to be applied and the kind of medium used. Normally to achieve good coverage, the dispersions will contain complementarily 50-91% wt. inorganic solids and 50-9% wt. medium. The preferred compositions of the present invention will be at the higher end of solids loading, or about 80-91%, of the weight fraction for inorganic solids, and about 20-9%, weight fraction for medium so as to maximize solids content of the dried and/or cured ink deposition. The compositions of the present invention may, of course, be modified by the addition of other materials, which do not affect the beneficial characteristics. Such formulations and modifications thereof are well within the state of the art.

The viscosity of the composition is typically within the following ranges when measured on a Brookfield (Middleboro, Mass.) HBT viscometer at low, moderate and high shear rates:

| Shear Rate ($sec^{-1}$) | Viscosity (Pa * s) | |
|---|---|---|
| 0.2 | 100–5000 | |
| | 300–2000 | Preferred |
| | 600–1500 | Most Preferred |
| 4 | 40–400 | |
| | 30–100 | Most Preferred |
| | 120–200 | Preferred |
| 40 | 10–150 | |
| | 25–120 | Most Preferred |
| | 50–100 | Preferred |

The composition is printed on a substrate in the conventional manner as known to those in the art of thick film technology. The preferred manner of application is screen-printing. Screen-printing is an advantageous process to use for producing thin and dense magnetic polymer bonded magnets due to the inherent utility and proven high productivity of this technique. Using screen-printing, a variety of printed shapes and formats can be readily made using appropriate patterning of the printing screen. In addition, use of solvent based polymer thick film compositions allow higher metal volume fraction in the dried and/or cured polymer thick film due to the solvent being at least substantially removed from the printed film during the drying and/or curing process. The term "substantially" as used herein means removal of the solvent to a point to provide at least adequate properties for the composition's intended use or application. Curing is a low temperature process with temperatures usually less than 300° C. A separate drying step may precede the curing step or be an integral part of the curing. Examples of curing are: thermal curing in which heat initiates a reaction, usually cross-linking of polymer chains and ultra violet curing where ultra violet radiation, is used to initiate a polymer chain cross-linking or chain extension reaction. A low residual polymer content, and corresponding high metal volume after cure, results in a high metal volume fraction in the cured film resulting in maximized magnetic flux and desirable magnetic properties.

Screen-printing allows the fabrication of thin prints of the magnetic compositions since the prints are typically well supported on the substrates. As such, screen-printing represents an intermediate thickness application technology versus thin film depositions, usually applied by metallic evaporation and deposition, and polymer bonded materials, made using molding of mixtures of the magnetic powders and polymeric resins.

There is no limit to the type of substrates that may be used. Some examples would be electrically or thermally conductive materials, metal, paper, plastic, glass, polyester or other polymeric substrates. The substrate may be chosen by properties such as: color, thickness, flexibility, cost, availability, post-processing properties such as adhesion to other substrates, thermal expansion, adhesion, and $T_g$ matching. High volume processing of such printing is possible using reel-to-reel or web-based printing where the substrate is amenable to such processing. Another advantage of the screen-printing process is that the residual polymer of the cured printed film coats the magnetic particles such that they may be resistant to adverse and detrimental reactions with ambient atmosphere. This is a particular advantage for polymeric thick film compositions containing Nd—Fe—B or Neo powders since such powders are well known to be prone to surface oxidation or rusting due to the high Fe content of the powder. Polymeric thick film applications of magnetic particles are also useful in that the film as printed can be isotropic in nature such that the direction of a subsequently applied magnetic field can be done in any direction versus the shape and thickness of the film. This property of magnetic isotropy is aided when the Neo powders are specifically used. In addition, flake-like or plate-like magnetic particles can also be printed in an anisotropic printing mode such that the microstructure of the finished print exhibits flaked particles mostly lying aligned within and parallel to the plane of the screen print. Such particle orientation as a result of the action of screen-printing is well known in the art, such as in the case of conductive thick film compositions containing plate-like or flake-like Ag particles. Orientation induced by the printing process can lead to enhanced magnetic properties due to the orientation of the magnetic particles in such a manner.

In order for polymeric thick film compositions to have optimum utility for screen-printing magnetic patterns, the composition should exhibit the following properties: screen printable viscosity of at least 5 Pas (5,000 cps) or higher at typical shear rates for best screen-printing performance and pattern resolution; a maximum viscosity of about 200 Pas (200,000 cps) for best screen-printing speed and print cosmetic properties; contain a solvent which is appropriately volatile and can evaporate within reasonable times after printing and drying for utility in high speed printing and processing and is appropriately non-volatile such that it can be worked on the screen during the screen-printing process without excessive solvent evaporation and subsequent viscosity increase; contain a polymer which allows evaporation of the associated solvent within reasonable time frames for rapid printing and curing; contain a polymer which will result in a printed film which has appropriate bonding capability to the substrate so as to avoid dried composition spalling or friability of the printed and cured composition; contain solvents and polymers which are non-reactive to the metal particles incorporated therein which could lead to viscosity increase with time; be capable of formulation to a maximized metal powder content to maximize magnetic flux after printing, curing and magnetization; be capable of containing a minimized polymer content, to maximize magnetic flux after printing, curing and magnetization, yet retain desirable properties; allow printing in thicknesses on the order of several mils of thickness per printing pass since most applications of screen printed magnetic thick film compositions are expected to require relatively thick composition depositions versus the standard of less than 1 mil for Ag conductor and other polymer thick film compositions; be amenable to screen-printing with respect to smell and safety and flammability and other operator-sensitive aspects; be flexible after drying or curing such that the printed substrate can be handled easily and without damage in later manufacturing steps including magnetization; coat the powders adequately such that reaction with ambient atmosphere cannot degrade or alter the properties of the powders contained in the composition; optionally result in sufficient open surface porosity in the thick film such that an added polymer can be impregnated into the cured and dried print to enhance mechanical properties; and in the case of materials within the Neo system capable of containing powders with relatively coarse particle size distributions and low surface areas due to the potential for pyrophoric reactions of such powders in air if milled to particle size distributions typical of other polymer thick film inks containing Ag particles and the like.

EXAMPLES

All weight percents given in the examples are based on total composition unless otherwise stated.

Example 1

A medium suitable to fabrication of a polymeric thick film composition was made using the following ingredients:

| Ingredient | Weight Percent |
|---|---|
| Carbitol Acetate (UCAR Inc., CAS 112-15-2) | 15 |
| Phenoxy Polymer PKHH (Phenoxy Associates, CAS 25068-38-6) | 25 |
| Dowanol DPM (Dow Chemical, dipropylene glycol methyl ether; CAS 34590-94-8) | 60 |

The medium was made using a high shear heated mixer by heating the mix to approximately 40° C. and mixing with high shear for about three hours. Viscosity at 25° C. was measured after cooling and was in the range of 5 to 9 Pas at a shear rate of 4 reciprocal seconds. Solids content of the medium was between 24% and 26% measured using a sample prepared by calcination of a medium aliquot and measuring weight loss at approximately 150° C. for about 2 hours in air.

A Neo powder of suitable particle size distribution for thick film composition applications was prepared by dry-milling a melt-spun and quenched Nd—Fe—B composition (type NCLC, Ultrafine Powders, Woonsocket R.I.) using a "00" sized alumina jar-mill 50% volume loaded with half inch diameter and half inch length cylindrical alumina media. 500 grams of NCLC powder was loaded and the dry-milling of the powder done at about 50 RPM jar rotation speed for about 16 hours. The particle size distribution of the powder after milling was measured and had the following characteristics:

PSD D10=20.5 microns

PSD D50=63.2 microns

PSD D90=109.6 microns

Surface area (BET method)=0.28 square meters/gram

The magnetic characteristics of the starting Neo powder were:

Br=9.7 kG

Hc=2.1 kOe

Hci=2.6 kOe

BHmax=6.0 MGOe

This powder was compounded with the above medium using these ratios:

| Ingredient | Weight Percent |
|---|---|
| Powder | 85.4 |
| Medium | 10.8 |
| Dowanol DPM (Dow Chemical, dipropylene glycol methyl ether; CAS 34590-94-8 | 3.8 |

Mixing and powder dispersion was achieved by using a high speed saw-tooth type of mixer for about 3 hours, using a slower paddle feed blade to enhance the mixing and dispersion process. After dispersion processing a plasticizer of 1.5% dibutyl phthalate (CAS 84-74-2) was mixed in using slow stirring.

Final thick film composition product properties were measured:

Solids (measured using a calcination of a composition aliquot at about 150° C. for about 2 hours)=87.0%

Viscosity at 25° C. and 4 reciprocal seconds=40.5 Pas (40,500 cps)

Overall dispersion using Hegeman gauge=approximately 40 microns

Volume fraction metal in the dried film=approximately 81% assuming the Neo powder density is 7.4 g/cc and the residual phenoxy polymer=1 g/cc.

The composition was screen-printed using a web-based printing type process using a series of complex screen patterns and was found to print and cure adequately using standard cure times and temperatures, and permitted thick prints of approximately 4 mils cured per printing stage. Cure times and temperatures were approximately 130° C. for 10 minutes in an air atmosphere. The prints were flexible and tough and easily handled after the printing process. Magnetization was performed and the degree of magnetization and resulting flux was found suitable for the application the prints were to be used in.

Example 2

A medium suitable to fabrication of a polymeric thick film composition was made using the following ingredients:

| Ingredient | Weight Percent |
|---|---|
| Dowanol DPM (Dow Chemical, dipropylene glycol methyl ether; CAS 34590-94-8) | 80 |
| Polyurethane (CAS 68698-81-7) | 15 |

-continued

| Ingredient | Weight Percent |
|---|---|
| Huntsman Polyurethanes, product number PA279-503, trade name "Irostic" | |
| Phenoxy Polymer PKHH (Phenoxy Associates, CAS 25068-38-6) | 5 |

The medium was made using a high shear heated mixer by heating to approximately 95° C. for about three hours. After mixing the medium was filtered through a 325 mesh wire screen. Viscosity at 25° C. was measured after cooling and was in the range of 5 to 10 Pas at a shear rate of between 1 and 10 reciprocal seconds. Solids content of the medium was between 19 and 21% measured using calcination of a medium aliquot and measuring weight loss at about 150° C. for about 2 hours in air.

A powder within the system Nd—Fe—B was prepared by atomization from the melt (Magnequench Inc., MQP-10-8 powder). The particle size distribution of the powder was measured with the following characteristics:

PSD D10=20.7 microns

PSD D50=36.4 microns

PSD D90=63.6 microns

Surface area (by the BET method)=0.22 square meters/gram

The magnetic characteristics of this powder were:

Br=7.3 kG

Hc=5.1 kOe

Hci=8.4 kOe

BHmax=10.9 MGOe

This powder was compounded with the above medium using these ratios:

| Ingredient | Weight Percent |
|---|---|
| Powder | 88.6 |
| Medium | 9.5 |
| Dowanol DPM (Dow Chemical, dipropylene glycol methyl ether; CAS 34590-94-8 | 1.9 |

Mixing and powder dispersion was achieved by using a low shear double planetary mixer for about 2 hours while applying vacuum. The mix was then three roll-milled to an end point defined using a Hegeman fineness-of-grind gauge.

Final product properties were measured:

Solids (measured using a calcination of a composition aliquot at about 150° C. for about 2 hours)=89.2%

Viscosity at 25° C. and 4 reciprocal seconds=approximately 138 Pas (138,000 cps)

Overall dispersion using Hegeman gauge=about 10 microns

Volume fraction metal in the dried film=approximately 83.4% assuming the Neo powder density is 7.4 g/cc and the residual polymer=1 g/cc.

The composition was screen-printed using a sheet based printing type process using a series of complex screen patterns and was found to cure adequately using standard cure times and temperatures, permitted thick prints of approximately 4 mils cured per printing stage and the prints were flexible and tough and easily handled after the printing process. Cure times and temperatures were approximately 130° C. for 10 minutes in an air atmosphere. Magnetization experiments were performed on the sheets and the degree of magnetization was found to be acceptable for the application.

What is claimed is:

1. A magnetic tick film composition comprising particles of permanent magnetic materials comprising Nd—Fe—B system materials, having isotropic characteristics, wherein said permanent magnetic materials, are dispersed in organic medium wherein the medium consists of a polymer selected from polyurethane, phenoxy and mixtures thereof, and organic solvent.

2. A magnetic thick film composition comprising particles of permanent magnetic materials comprising Nd—Fe—B system materials, having isotropic characteristics, dispersed in organic medium wherein the medium consists of a polymer selected from polyurethane, phenoxy and mixtures thereof, and organic solvent, wherein said particles of permanent magnetic materials further comprise other rare earth metals that contribute to the magnetic properties selected from Pr, Sm, Eu, Gd, and mixtures thereof.

3. The composition as in claim 1 wherein said particles of permanent magnetic materials further comprise other transition metals selected from Cr, Ni, Co, Mn, and mixtures thereof.

4. The composition of claim 1 or claim 2 wherein the magnetic particles are found in the composition in the range of 50-91% by weight based on total composition.

5. The composition of claim 1 or claim 2 wherein the organic medium is found in the composition in the range of 9-50% by weight based on total composition.

6. The composition claim 1 or claim 2 which is of paste consistency suitable for screen-printing.

7. The composition of claim 1 or claim 2 disposed on a substrate wherein the composition is processed to at least substantially remove the organic solvent.

8. The composition of claim 6 wherein the composition is applied to a substrate by a disposing means.

9. The composition of claim 8 wherein the disposing means is selected from screen-printing, spraying, doctor blading, brushing and dipping.

10. The composition of claim 1 wherein said particles of permanent magnetic materials further comprise rare earth and transition metals selected from the group consisting of Pr, Sm, Eu, Gd, and mixtures thereof and from Cr, Ni, Co, Mn, and mixtures thereof.

11. The composition of claim 1, which is of paste consistency suitable for screen-printing.

12. The composition of claim 1 wherein said polymer is a linear polymer.

13. The composition of claim 1 wherein said polymer has an average molecular weight in the range of 40,000 to 60,000.

14. The composition of claim 1 wherein said composition has a viscosity in the range of 5 to 30 PaS.

15. The composition of claim 1 wherein said composition, as printed, is isotropic in nature such that the direction of a subsequently applied magnetic field can be done in any direction versus the shape and thickness of a resulting film.

16. A magnetic thick film composition having isotropic characteristics, comprising particles of permanent magnetic materials comprising Nd—Fe—B system materials, dispersed in organic medium wherein the medium consist of a polymer selected from polyurethane, phenoxy and mixtures thereof, and organic solvent, wherein said particles of permanent magnetic materials further comprise other rare earth metals that contribute to the magnetic properties selected from the group consisting of Pr, Sm, Eu, Gd, and mixtures thereof and other transition metals selected from the group consisting of Cr, Ni, Co, Mn, and mixtures thereof.

17. An isotropic magnetic thick film composition comprising particles of permanent magnetic materials comprising Nd—Fe—B powder, dispersed in organic medium, and organic solvent and wherein said powder is selected from the group consisting of atomized powders and dry-milled powders and wherein the medium consists of a polymer selected from the group consisting of polyurethane, phenoxy and mixtures thereof.

* * * * *